United States Patent [19]

Thorpe et al.

[11] Patent Number: 4,583,786

[45] Date of Patent: Apr. 22, 1986

[54] MINERAL MINING PICK AND HOLDER ASSEMBLY

[75] Inventors: John D. Thorpe; George Joel, both of Sheffield, Great Britain

[73] Assignee: Padley & Venables Limited, Great Britain

[21] Appl. No.: 556,096

[22] Filed: Nov. 29, 1983

[30] Foreign Application Priority Data

Mar. 2, 1983 [GB] United Kingdom ..... 8305778

[51] Int. Cl.[4] ..... E21C 7/08; E21C 35/22; E21F 5/02

[52] U.S. Cl. ..... 299/81; 299/92

[58] Field of Search ..... 299/81, 12, 92; 175/243; 285/110, 374, 305; 37/142 A, 142 R

[56] References Cited

U.S. PATENT DOCUMENTS

| | | | |
|---|---|---|---|
| 3,532,367 | 10/1970 | Roos | 285/321 |
| 4,111,464 | 9/1978 | Asano et al. | 285/321 |
| 4,453,775 | 6/1984 | Clemmow | 299/81 |

FOREIGN PATENT DOCUMENTS

| | | | |
|---|---|---|---|
| 2932511 | 2/1981 | Fed. Rep. of Germany | 299/81 |
| 961239 | 6/1964 | United Kingdom . | |
| 1036535 | 7/1966 | United Kingdom . | |
| 1057830 | 2/1967 | United Kingdom | 299/81 |
| 1443373 | 7/1976 | United Kingdom . | |
| 2088441 | 9/1982 | United Kingdom | 299/81 |
| 2104945 | 3/1983 | United Kingdom | 299/81 |
| 717326 | 2/1980 | U.S.S.R. | 299/81 |

*Primary Examiner*—Stephen J. Novosad
*Assistant Examiner*—Michael Goodwin
*Attorney, Agent, or Firm*—Wigman & Cohen

[57] ABSTRACT

The combination of a mineral mining pick and a pick holder. The pick 1 has a shank 4 by which it is received in a socket 6 of a pick holder 2. Extending within the socket 6 is a spigot 13 which mates with a coupling socket 14 in the shank 4 automatically as the shank is inserted into the pick holder. During insertion of the spigot 13 into the socket 14, a frusto conical head 26 on the spigot passes through a resilient ring 25 mounted in an annular recess 24 of the coupling socket so that abutment of a shoulder 27 on the head 26 against the ring 25 retains the pick in the holder.

The spigot 13 may be tubular to provide a water coupling from chamber 23 in the holder to passage 11 and ports 12 in the pick for flushing, cooling or dust suppression water supply. The resilient retaining ring 25 may provide a water seal between the spigot 13 and the socket 14.

In an alternative arrangement the spigot can be carried by the shank 4 to engage in a coupling socket in the holder 2.

24 Claims, 1 Drawing Figure

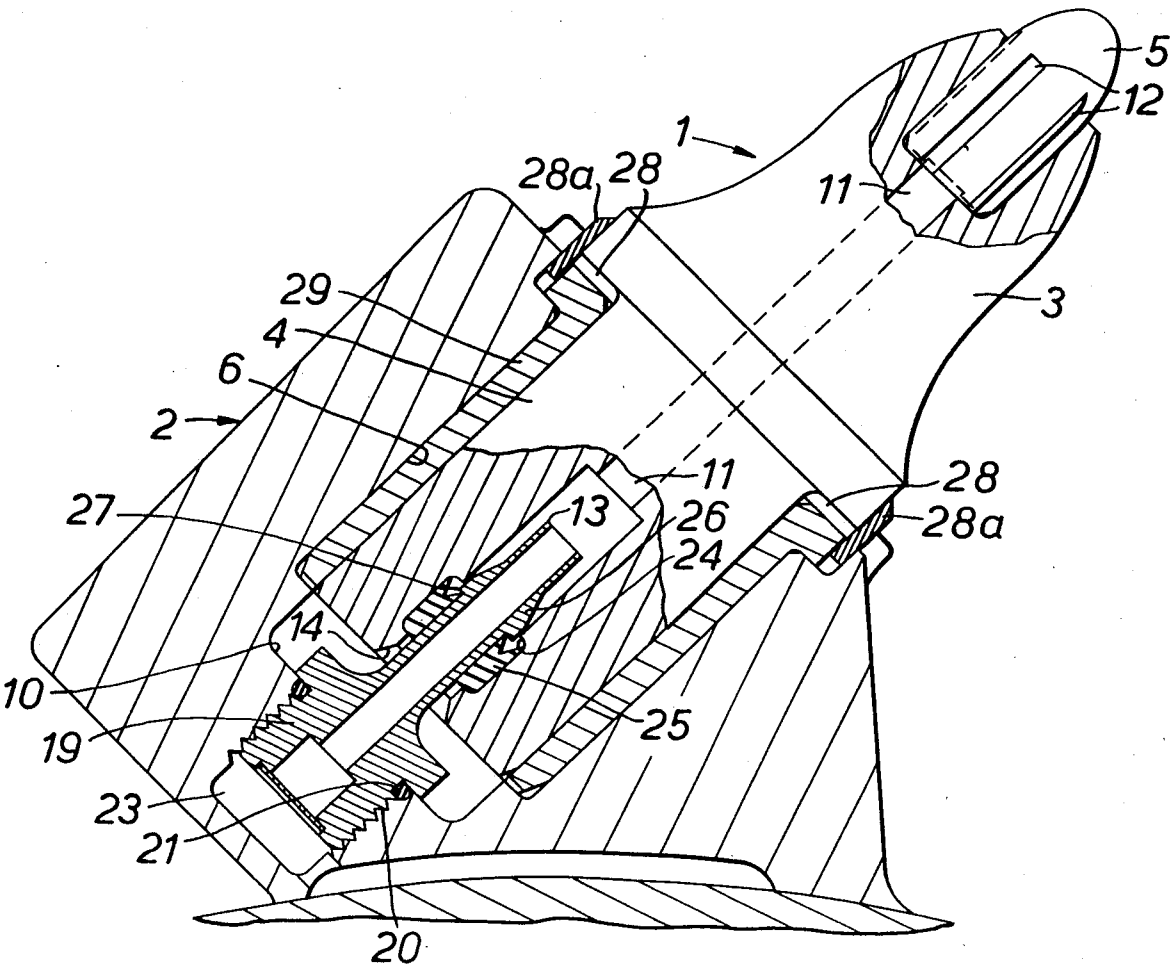
5
12
3
28
28a
11
1
28
28a
11
26
24
25
13
29
4
6
2
27
14
10
19
23
21
20

MINERAL MINING PICK AND HOLDER ASSEMBLY

TECHNICAL FIELD AND BACKGROUND ART

This invention relates to a mineral mining pick (which term, as is generally acknowledged in the art, includes a pick for rock mining and for road planing) and a pick holder by which the pick is operatively retained and which is likely to be in the form of a socketed block or box on or in a driven drum of a mining machine but may be the drum itself.

It is conventional practice in pick and holder combinations to provide retaining means by which the pick is held in the holder during use but which can be manually disengaged to release the pick from the holder for servicing or replacement. The usual form of pick and holder combinations has a shank of the pick received in a complementary socket in the holder and generally the retaining means comprises a spring or similarly loaded pin carried by either the shank or the holder to be biased into engagement with a recess in the holder or shank as the case may be to provide the necessary retention; release of the pin to permit removal of the pick is achieved by displacing the pin against its biasing sufficient to clear the recess. A well known example of such retaining means is referred to in the art as the "stud-lock", an example of which is disclosed in GB Specification No. 1,144,434 while an alternative form of retaining means is disclosed in GB Specification No. 1,170,979. The machining and fitting necessary to provide the retaining means between the pick and its holder contributes considerably towards the manufacturing costs of the pick and holder and the wear and tear to which the retaining means is subjected in use usually necessitates their frequent servicing and replacement. Furthermore, with the conventional form of retaining means it is usually considered impractical or inconvenient to fit replacement parts on site and often the retaining effect which is provided is far greater than that considered necessary for safety (this together with poorly conceived principles of construction and/or undesirable location of the retaining means frequently results in difficulties being encountered for release of the pick). It is an object of the present invention to provide the combination of a pick and a pick holder by which the aforementioned disadvantages of conventional means for retaining the pick in the holder are alleviated.

STATEMENT OF INVENTION AND ADVANTAGES

According to the present invention there is provided the combination of a mineral mining pick and a pick holder; said pick comprising a body having a head with a cutting part and a shank which extends longitudinally from the head; said holder comprising a shank socket within which the shank is longitudinally received; and retaining means for releasably retaining the shank in the socket, said retaining means comprising a spigot carried by one of said pick and pick holder members and extending longitudinally of the shank or socket and a coupling socket carried by the other of said pick and pick holder members, said coupling socket longitudinally receiving the spigot during insertion of the shank into the shank socket, and wherein the spigot has a shoulder and the coupling socket carries a resilient retainer which engages over said shoulder of the spigot during insertion of the shank into the shank socket to retain the shank in its socket.

By the present invention (which is readily applicable to pick shanks and shank sockets of any shape in lateral section as well as the usual circular, rectangular or polygonal section) the spigot is intended to mate automatically with the coupling socket as the pick is fitted to the pick holder so that the resilient retainer will automatically engage over the shoulder of the spigot. In this way a simple and straightforward connection can be provided between the pick and its holder with the resilience of the resilient retainer providing the required restraint to prevent removal of the pick. When the pick is to be removed it is intended that the resilient restraint afforded by the resilient retainer can be overcome upon a reasonable withdrawal force being applied to the pick which force is sufficient to deform the resilient retainer sufficiently to allow the spigot and coupling socket to be disengaged. It is envisaged that the resilient retainer will usually be in the form of a rubber or synthetic ring of flexible material simply fitted in an annular recess or seating of the coupling socket so that if this annular ring is at all damaged during removal of the pick it is a simple matter to fit a further ring on site.

The present invention was primarily developed for pick and holder combinations in which a fluid such as water is directed into the cutting region of the pick for the purposes of dust suppression, flushing and cooling (which latter term includes the alleviation of incendive sparking) and as an improvement to the combination discussed in our GB Specification No. 2,088,441. With this in mind the spigot is preferably tubular, the bore of which communicates with a fluid passage in the member which carries it while the fluid coupling socket is in communication with a fluid passage of its member so that fluid flow communication can be effected from a fluid supply to the holder to passage means in the body of the pick feeding an outlet port in that body. In this fluid flow coupling provided between the spigot and the coupling socket, it is preferred that the resilient retainer comprises a fluid seal between the spigot and its coupling socket.

Preferably the shoulder on the spigot is formed by an enlarged part (conveniently referred to as a head part) of that spigot which is conveniently tapered to provide a lead-in surface (which will usually be frusto conical) for convenience of mating the spigot with its coupling socket.

As is envisaged by the disclosure in our Specification GB No. 2,088,441, the spigot can be carried by either the pick or the holder but is preferably carried by the latter.

Where the spigot and coupling socket provide fluid flow communication as aforementioned, it is preferable, but not essential, that the pick is subjected to water flow therethrough only during the period for which it is cutting so that the usage of water is maintained at that necessary for optimum efficiency. Accordingly, valve means may be provided by which the water supply to the pick can be effected substantially only during the period for which the pick is cutting.

DRAWING

One embodiment of the present invention will now be described, by way of example only, with reference to the accompanying illustrative drawing, which shows the combination of a coal mining pick and a pick holder in part section and which combination has the facility for supplying water to the pick head.

DETAILED DESCRIPTION OF DRAWING

The combination illustrated is primarily intended for heavy duty coal cutting and comprises a point attack pick 1 mounted in a pick holder 2. The pick 1 is generally of conventional shape for point attack and comprises a one piece steel body having a head 3 and a shank 4 which extends longitudinally from the head. Mounted in the head 3 is a tungsten carbide insert 5 which forms a cutting part or tip to the pick. Provided in the holder 2 is a shank socket 6 which receives the shank 4 in a substantially complementary manner, the shank being inserted longitudinally into the socket 6 through the mouth thereof. The shank 4 and socket 6 may conveniently be regarded as cylindrical.

The pick holder 2 is in the form of a block or box which is secured for movement as part of a coal cutting machine to displace the cutting tip 5 as appropriate for coal cutting. In the present embodiment the holder 2 is shown secured to a coal shearer drum which is rotatable about its longitudinal axis to effect cutting with the pick retained in the holder to project outwardly of the drum at a calculated angle of attack to the coal face.

Formed within the body of the pick 1 is a passage 11 which extends longitudinally through and co-axial with the shank 4 into the head 3 where it communicates with outlet ports 12 formed between recesses in the side face of the insert 5 and a face of the pick head 3 which opposes those recesses in the manner discussed in our GB Specification No. 2,087,949. The passage 11 and outlet ports 12 are intended for the flow therethrough of water which is primarily intended for the purposes of dust suppression, flushing and cooling during coal cutting. Generally the water will emanate from a source within the coal cutting machine and consequently provision is made within the pick holder 2 for coupling the water supply to the passage 11. To provide this coupling for the water supply and also to provide a means of retaining the pick 1 in the holder 2, there is carried within the shank socket 6 a tubular spigot 13 which engages within a coupling socket 14 formed in the free end of the shank 4. The tubular spigot 13 extends longitudinally from the bottom wall 10 of, and is co-axial with, the socket 6, while the coupling socket is co-axial with the shank 4 and forms an extension of the passage 11. It will be realised from the drawing that the tubular spigot 13 will automatically mate with the coupling socket 14 as the shank 4 is inserted longitudinally into the shank socket 6.

The tubular spigot 13 is carried in the holder by a tubular mounting 19 having a male thread which engages with a female threaded bore 20 in the holder 2. An annular seal 21 is provided between a shoulder of the mounting 19 and the bottom wall 10 of the shank socket. The bore of the tubular spigot 13 communicates through the bore of the tubular mounting 19 with a chamber 23 which is in communication with a source of water under pressure within the coal cutting machine in accordance with conventional practice.

The tubular spigot and mounting 13, 19 are conveniently formed as a single component which is removable through the mouth of the shank socket 6 for replacement or servicing purposes.

Seated in an annular recess 24 within the coupling socket 14 is an annular sealing member 25 of resilient material which is intended to form a high pressure water seal between the spigot 13 and its socket 14 and also to constitute part of a means for retaining the pick shank 4 within the socket 6. To provide the aforementioned retention the tubular spigot 13 has a head 26 the external profile of which is frusto conical to provide a tapered lead-in surface during insertion of the tubular spigot into the socket 14 and through the annular sealing member 25. When the shank 4 has been fully inserted into the socket 6 the head 26 of the spigot 13 is arranged to have moved through the seal 25 so that the latter, having passed over the head 26, flexes into engagement behind an annular shoulder 27 on the head; it is the abutment of this shoulder 27 against the sealing ring 25 which restrains the pick from being withdrawn from the socket 6.

It will be seen from the drawing that the high pressure sealing ring 25 is in the form of a so-called "W" seal whereby an annular recess in the end face of the sealing ring is directed towards the free end of the spigot 13 so that water pressure which develops within the passage 11 and reacts on the end face of the seal 25 tends to urge the lips of the seal into better sealing engagement with the wall of the annular recess 14 and the opposing wall of the spigot 13. This improved sealing effect will give a corresponding improvement in the retention provided by the sealing member 25 reacting against the shoulder 27 behind the head 26. When it is required to remove the pick 1 from the pick holder 2 a longitudinally directed force is applied to the head 3 which force is sufficient to overcome the restraining effect of the sealing member 25 and allow the shank 4 to be withdrawn from the holder. During this latter withdrawal it is possible that the sealing member 25 will be dislodged from its seating recess 24 or be damaged but in either event it is an easy matter to locate a new sealing member 25 in the recess 24 as a simple push fit.

During its use it is possible that the pick 1 will undergo limited longitudinal displacement relative to the pick holder 2 (to an extent determined by the bottoming of the pick into the socket 6 and the displacement of the pick outwardly from the socket as permitted by the flexure of the sealing and retaining member 25) and during this restricted displacement of the pick an annular clearance 28 will open and close between a shoulder formed between the pick head 3 and the shank 4 and the face of the holder 2 which opposes that shoulder. To alleviate the entry of detritus into the clearance 28 a seal in the form of an "O" ring, a sleeve or similar component **28*a* is provided around the pick head to close the clearance 28**.

During use the shank socket 6 can be subjected to considerable wear and to alleviate this the socket 6 is provided with a sleeve 29 conveniently formed as a moulding in plastics material. The sleeve 29 is a complementary fit within the socket 6 to be removable therefrom and receives the shank 4 in a substantially complementary manner. Naturally the sleeve 29 will be subjected to wear during use of the pick 1 and where necessary it can be replaced at relatively little expense (and certainly at less expense than replacing the holder 2 as may be necessary in the event of wear in the socket 6). The sleeve 29 conveniently provides a means of locating and retaining the sealing sleeve **28*a* on the pick holder and, if required, these sleeves 28*a* and 29 can be integral. It will of course be realised that the sleeves 28*a* and 29** can be omitted without detracting from the advantages of the present invention.

To utilise the water efficiently, there may be provided valve means (not shown) which serves to cut-off the flow of water into the passage 11 when the pick is out of contact with the mineral face. This valve means may be of conventional type which is responsive to the arcuate positioning of the pick during rotation of the drum so that water supply is provided to the outlet ports 12 substantially only for the period during which the pick is in engagement with the mineral face. Preferably however the valve means is in accordance with the invention which is the subject of our co-pending GB Application No. 8305765 whereby the aforementioned longitudinal displacement of the pick during use controls a valve member which actuates the valve means to allow water to flow to the outlet ports 12 when the pick is displaced longitudinally in response to the pressure to which it is subjected during cutting engagement with the coal face and to cut-off the said water flow when the pick moves out of said cutting engagement and is displaced by the water pressure within the pick/holder combination.

We claim:

1. The combination of a mineral mining pick and a pick holder, said pick comprising a body having a head with a cutting part and a shank which extends longitudinally from the head, said holder comprising a shank socket within which the shank is longitudinally received, and retaining means for releaseably retaining the shank in the shank socket, said retaining means comprising a spigot carried by one of said pick and pick holder members and extending longitudinally of the shank or shank socket, a coupling socket carried by the other of said pick and pick holder members and a resilient retainer disposed in said coupling socket, and forming a fluid seal between said coupling socket and said spigot, said coupling socket longitudinally receiving the spigot during insertion of the shank into the shank socket, said spigot having a shoulder passing completely through said resilient retainer during insertion of the shank into the shank socket such that said shoulder engages a surface of said resilient retainer to resist withdrawal of said spigot from said resilient retainer to thereby releasably retain the shank in said shank socket.

2. The combination as claimed in claim 1 in which the shoulder is formed by a head part of the spigot, said head part being tapered to provide a lead-in surface for mating the spigot with the coupling socket.

3. The combination as claimed in claim 1 in which the resilient retainer comprises a ring member seated in an annular recess within the coupling socket.

4. The combination as claimed in claim 1 in which the spigot is tubular, the bore of which communicates with a fluid passage in the member which carries the spigot and the fluid coupling socket is in communication with a fluid passage of its member so that fluid flow communication can be effected from a fluid supply to the holder to passage means in the body of the pick for supplying fluid to an outlet port in the pick.

5. The combination as claimed in claim 1 in which the spigot is carried by the pick holder to be received by the coupling socket in the shank.

6. The combination as claimed in claim 5 in which the spigot is screw threadedly mounted in the holder to be removable therefrom through the mouth of the shank socket.

7. The combination as claimed in claim 1, including means on said spigot for guiding said shoulder completely through said resilient retainer during insertion of the shank into the shank socket.

8. The combination as claimed in claim 7, wherein said guiding means comprises a tapered portion of said spigot to provide a lead-in surface for said shoulder to pass completely through said resilient retainer.

9. The combination of a mineral mining pick and a pick holder, said pick comprising a body having a head with a cutting part and a shank which extends longitudinally from the head, said holder comprising a shank socket within which the shank is longitudinally received, and retaining means for releasably retaining the shank in the shank socket, said retaining means comprising a spigot carried by one of said pick and pick holder members and extending longitudinally of the shank or shank socket, a coupling socket carried by the other of said pick and pick holder members and a resilient retainer disposed in said coupling socket, said coupling socket longitudinally receiving the spigot during insertion of the shank into the shank socket, said spigot having a shoulder passing completely through said resilient retainer such that said shoulder engages a surface of said resilient retainer to resist withdrawal of said spigot from said resilient retainer to thereby releasably retain the shank in said shank socket, said resilient retainer forming a fluid seal between said coupling socket and said spigot, said shoulder being formed by a head part of the spigot, said head part being tapered to provide a lead-in surface of mating the spigot with the coupling socket, said head part being frusto conical and carrying an annular shoulder against which the resilient retainer engages in abutment.

10. The combination of a mineral mining pick and a pick holder, said pick comprising a body having a head with a cutting part and a shank which extends longitudinally from the head, said holder comprising a shank socket within which the shank is longitudinally received, and retaining means for releasably retaining the shank in the shank socket, said retaining means comprising a spigot carried by one of said pick and pick holder members and extending longitudinally of the shank or shank socket, a coupling socket carried by the other of pick and pick holder members and a resilient retainer disposed in said coupling socket, said coupling socket longitudinally receiving the said spigot during insertion of the shank into the shank socket, said spigot having a shoulder passing completely through said resiiient retainer such that said shoulder engages a surface of said resilient retainer to resist withdrawal of said spigot from said resilient retainer to thereby releasably retain the shank in said shank socket, said resilient retainer forming a fluid seal between said coupling socket and said spigot, said pick being capable of restricted longitudinal displacement relative to the pick holder when retained by said retaining means, a shoulder formed between the pick head and the shank, a seal disposed between the pick holder and the pick head, said seal bridging a clearance which opens and closes between said shoulder and the pick holder during longitudinal displacement of the pick relative to its holder to alleviate the entry of detritus into said clearance.

11. The combination of a mineral mining pick and a pick holder, said pick comprising a body having a head with a cutting part and a shank, said pick holder having a shank socket for receiving said shank and retaining means for releasably retaining the shank in the shank socket, said retaining means comprising a spigot carried by said pick holder and extending longitudinally thereof and a coupling socket formed by a longitudinal bore in said shank, said coupling socket carrying a resilient retainer and longitudinally receiving the spigot during insertion of the shank into the shank socket, said spigot having a shoulder passing completely through said resilient retainer during insertion of the shank into the shank socket such that said shoulder engages a surface of said resilient retainer to resist withdrawal of said spigot from said resilient retainer to thereby releasably retain the shank in said shank socket.

12. The combination as claimed in claim 11, wherein said spigot has a longitudinal bore which communicates with a first fluid passageway in said pick holder, the head of said pick having a second fluid passageway communicating with the coupling socket of said shank whereby fluid flow communication is effected between said first and second fluid passageways when said shank is inserted in said shank socket.

13. The combination as claimed in claim 12, wherein said resilient retainer comprises a fluid seal between the spigot and the coupling socket in the longitudinal bore of the shank.

14. The combination as claimed in claim 13, wherein said resilient retainer comprises an annular, W-type seal whereby fluid pressure acting on the surface of said retainer confronting the shoulder on the spigot urges the resilient retainer into tighter sealing engagement with both the coupling socket and the spigot.

15. The combination as claimed in claim 11, including an annular recess formed in said coupling socket for receiving said resilient retainer.

16. The combination as claimed in claim 11, including means on said spigot for guiding said shoulder completely through said resilient retainer during insertion of the shank into the shank socket.

17. The combination as claimed in claim 16, wherein said guiding means comprises a tapered portion of said spigot to provide a lead-in surface for said shoulder to pass completely through said resilient retainer.

18. The combination of a mineral mining pick and a pick holder, said pick comprising a body having a head with a cutting part and a shank, said pick holder having a shank socket for receiving said shank and retaining means for releasably retaining the shank in the shank socket, said retaining means comprising a spigot carried by one of said pick and pick holder and extending longitudinally of the shank or shank socket and a coupling socket carried by the other of said pick and pick holder, said coupling socket longitudinally receiving the spigot during insertion of the shank into the shank socket, said retaining means further comprising an annular shoulder on said spigot and an annular resilient sealing means in said socket for engaging against said annular shoulder to resist withdrawal of said spigot from said sealing means and thereby releasably retain the shank in said shank socket and for forming a fluid seal between said spigot and said coupling socket, said retaining means comprising the sole means for releasably retaining the shank in the shank socket.

19. The combination as claimed in claim 18 wherein said spigot is formed with a tapered head part, said shoulder extending radially inwardly from said tapered head part toward the longitudinal axis of said spigot.

20. The combination as claimed in claim 19 wherein the tapered head part of said spigot extends completely through said annular sealing means such that said shoulder is engagable with said sealing means.

21. The combination as claimed in claim 18, including means on said spigot for guiding said shoulder completely through said resilient retainer during insertion of the shank into the shank socket.

22. The combination as claimed in claim 21, wherein said guiding means comprises a tapered portion of said spigot to provide a lead-in surface for said shoulder to pass completely through said resilient retainer.

23. A pick holder for a mineral mining pick having a shank with a coupling socket carrying a resilient retainer said pick holder comprising a shank socket for receiving the shank of the pick, retaining means in said shank socket for releasably retaining the shank in the shank socket, said retaining means comprising a spigot carried by the pick holder, said spigot having a shoulder adapted to pass completely through the resilient retainer in the coupling socket during insertion of the shank into the shank socket such that said shoulder engages a surface of the resilient retainer to thereby releasably retain the shank in said shank socket and means on said spigot for guiding said shoulder completely through said resilient retainer.

24. The pick holder as claimed in claim 23 wherein said guiding means comprises a tapered portion of said spigot to provide a lead-in surface for said shoulder to pass completely through the resilient retainer.

* * * * *